US008942988B2

(12) United States Patent
Gao

(10) Patent No.: US 8,942,988 B2
(45) Date of Patent: *Jan. 27, 2015

(54) EFFICIENT TEMPORAL ENVELOPE CODING APPROACH BY PREDICTION BETWEEN LOW BAND SIGNAL AND HIGH BAND SIGNAL

(71) Applicant: Huawei Technologies Co., Ltd., Shenzhen, Guangdong (CN)

(72) Inventor: Yang Gao, Mission Viejo, CA (US)

(73) Assignee: Huawei Technologies Co., Ltd., Shenzhen (CN)

( * ) Notice: Subject to any disclaimer, the term of this patent is extended or adjusted under 35 U.S.C. 154(b) by 149 days.

This patent is subject to a terminal disclaimer.

(21) Appl. No.: 13/625,874

(22) Filed: Sep. 25, 2012

(65) Prior Publication Data

US 2013/0030797 A1 Jan. 31, 2013

Related U.S. Application Data

(63) Continuation of application No. 12/554,868, filed on Sep. 4, 2009, now Pat. No. 8,352,279.

(60) Provisional application No. 61/094,879, filed on Sep. 6, 2008.

(51) Int. Cl.

| | |
|---|---|
| ***G10L 19/00*** | (2013.01) |
| ***G10L 19/02*** | (2013.01) |
| ***G10L 19/025*** | (2013.01) |
| ***G10L 19/002*** | (2013.01) |
| ***G10L 19/04*** | (2013.01) |

(52) U.S. Cl.

CPC ..... *G10L 19/0204* (2013.01); *G10L 19/025* (2013.01); *G10L 19/002* (2013.01); *G10L 19/04* (2013.01)

USPC ..... 704/500

(58) Field of Classification Search

CPC ..... G10L 19/002; G10L 19/025

USPC ..... 704/219, 225, 230, 500

See application file for complete search history.

(56) References Cited

U.S. PATENT DOCUMENTS 5,737,716 A 4/1998 Bergstrom et al.
7,065,485 B1 * 6/2006 Chong-White et al. ..... 704/208

(Continued)

OTHER PUBLICATIONS

Geiser et al. "Bandwidth Extension for Hierarchical Speech and Audio Coding in ITU-T Rec. G.729.1", IEEE Transactions on Audio, Speech, and Language Processing, vol. 15, No. 8, Nov. 2007.*

(Continued)

*Primary Examiner* — Jialong He

(74) *Attorney, Agent, or Firm* — Leydig, Voit & Mayer, Ltd.

(57) ABSTRACT

This invention provides a more efficient way to quantize temporal envelope shaping of high band signal by benefiting from energy relationship between low band signal and high band signal; if low band signal is well coded or it is coded with time domain codec such as CELP, temporal envelope shaping information of low band signal can be used to predict temporal envelope shaping of high band signal; the temporal envelope shaping prediction can bring significant saving of bits to precisely quantize temporal envelope shaping of high band signal. This prediction approach can be combined with other specific approach to further increase the efficiency and save mores bits.

16 Claims, 8 Drawing Sheets

(56) References Cited

U.S. PATENT DOCUMENTS

| | | | | |
|---|---|---|---|---|
| 7,069,212 | B2 | 6/2006 | Tanaka et al. | |
| 7,359,854 | B2 | 4/2008 | Nilsson et al. | |
| 7,801,733 | B2 | 9/2010 | Lee et al. | |
| 2003/0009327 | A1* | 1/2003 | Nilsson et al. | 704/219 |
| 2003/0093278 | A1* | 5/2003 | Malah | 704/265 |
| 2004/0078194 | A1* | 4/2004 | Liljeryd et al. | 704/200.1 |
| 2005/0004793 | A1* | 1/2005 | Ojala et al. | 704/219 |
| 2006/0149538 | A1* | 7/2006 | Lee et al. | 704/219 |
| 2006/0251178 | A1* | 11/2006 | Oshikiri | 375/242 |
| 2006/0277038 | A1 | 12/2006 | Vos et al. | |
| 2007/0016411 | A1 | 1/2007 | Kim et al. | |
| 2007/0016416 | A1 | 1/2007 | Roden et al. | |
| 2007/0033023 | A1 | 2/2007 | Sung et al. | |
| 2007/0067163 | A1 | 3/2007 | Kabal et al. | |
| 2007/0150269 | A1* | 6/2007 | Nongpiur et al. | 704/226 |
| 2007/0282599 | A1* | 12/2007 | Choo et al. | 704/205 |
| 2009/0198498 | A1 | 8/2009 | Ramabadran et al. | |
| 2010/0100373 | A1 | 4/2010 | Ehara et al. | |

OTHER PUBLICATIONS

First office action issued in corresponding U.S. Appl. No. 12/554,868, dated Mar. 31, 2012, total 19 pages.

Wei-Shou Hsu: "Robust Bandwidth Extension of Narrowband Speech", Thesis, Department of Electrical & Computer Engineering, McGill University, Nov. 2004, Montreal, Canada, total 76 pages.

Second office action issued in corresponding U.S. Appl. No. 12/554,868, dated Aug. 6, 2012, total 10 pages.

* cited by examiner

EFFICIENT TEMPORAL ENVELOPE CODING APPROACH BY PREDICTION BETWEEN LOW BAND SIGNAL AND HIGH BAND SIGNAL

CROSS-REFERENCE TO RELATED APPLICATIONS

This application is a continuation of U.S. patent application Ser. No. 12/554,868, filed on Sep. 4, 2009, which claims the priority of U.S. Provisional Application No. 61/094,879 filed on Sep. 6, 2008. The aforementioned patent applications are hereby incorporated by reference in their entireties.

FIELD OF THE INVENTION

The present invention is generally in the field of audio/speech coding. In particular, the present invention is in the field of low bit rate audio/speech coding.

BACKGROUND ART

Frequency domain coding (transform coding) has been widely used in various ITU-T, MPEG, and 3GPP standards. If bit rate is very low, a concept of BandWidth Extension (BWE) is well possible to be used. BWE usually comprises frequency envelope coding, temporal envelope coding, and spectral fine structure generation. Unavoidable errors in generating fine spectrum could lead to unstable decoded signal or obviously audible echoes especially for fast changing signal. Fine or precise quantization of temporal envelope shaping can clearly reduce echoes and/or perceptual distortion; but it could require lot of bits if traditional approach is used. A well known pre-art of BWE can be found in the standard ITU-T G.729.1 in which the algorithm is named as TDBWE (Time Domain Bandwidth Extension). The description of ITU-T G.729.1 related to TDBWE will be given here.

Frequency domain can be defined as FFT transformed domain; it can also be in MDCT (Modified Discrete Cosine Transform) domain.

General Description of ITU-T G.729.1

ITU G.729.1 is also called G.729EV coder which is an 8-32 kbit/s scalable wideband (50-7000 Hz) extension of ITU-T Rec. G.729. By default, the encoder input and decoder output are sampled at 16 000 Hz. The bitstream produced by the encoder is scalable and consists of 12 embedded layers, which will be referred to as Layers 1 to 12. Layer 1 is the core layer corresponding to a bit rate of 8 kbit/s. This layer is compliant with G.729 bitstream, which makes G.729EV interoperable with G.729. Layer 2 is a narrowband enhancement layer adding 4 kbit/s, while Layers 3 to 12 are wideband enhancement layers adding 20 kbit/s with steps of 2 kbit/s.

This coder is designed to operate with a digital signal sampled at 16000 Hz followed by conversion to 16-bit linear PCM for the input to the encoder. However, the 8000 Hz input sampling frequency is also supported. Similarly, the format of the decoder output is 16-bit linear PCM with a sampling frequency of 8000 or 16000 Hz. Other input/output characteristics should be converted to 16-bit linear PCM with 8000 or 16000 Hz sampling before encoding, or from 16-bit linear PCM to the appropriate format after decoding. The bitstream from the encoder to the decoder is defined within this Recommendation.

The G.729EV coder is built upon a three-stage structure: embedded Code-Excited Linear-Prediction (CELP) coding, Time-Domain Bandwidth Extension (TDBWE) and predictive transform coding that will be referred to as Time-Domain Aliasing Cancellation (TDAC). The embedded CELP stage generates Layers 1 and 2 which yield a narrowband synthesis (50-4000 Hz) at 8 and 12 kbit/s. The TDBWE stage generates Layer 3 and allows producing a wideband output (50-7000 Hz) at 14 kbit/s. The TDAC stage operates in the Modified Discrete Cosine Transform (MDCT) domain and generates Layers 4 to 12 to improve quality from 14 to 32 kbit/s. TDAC coding represents jointly the weighted CELP coding error signal in the 50-4000 Hz band and the input signal in the 4000-7000 Hz band.

The G.729EV coder operates on 20 ms frames. However, the embedded CELP coding stage operates on 10 ms frames, like G.729. As a result two 10 ms CELP frames are processed per 20 ms frame. In the following, to be consistent with the text of ITU-T Rec. G.729, the 20 ms frames used by G.729EV will be referred to as superframes, whereas the 10 ms frames and the 5 ms subframes involved in the CELP processing will be respectively called frames and subframes. In this G.729EV, TDBWE algorithm is related to our topics.

G.729.1 Encoder

A functional diagram of the encoder part is presented in FIG. 1. The encoder operates on 20 ms input superframes. By default, the input signal 101, $s_{WB}(n)$, is sampled at 16000 Hz. Therefore, the input superframes are 320 samples long. The input signal $s_{WB}(n)$ is first split into two sub-bands using a QMF filter bank defined by the filters $H_1(z)$ and $H_2(z)$. The lower-band input signal 102, $s_{LB}^{qmf}(n)$, obtained after decimation is pre-processed by a high-pass filter $H_{h1}(z)$ with 50 Hz cut-off frequency. The resulting signal 103, $s_{LB}(n)$, is coded by the 8-12 kbit/s narrowband embedded CELP encoder. To be consistent with ITU-T Rec. G.729, the signal $s_{LB}(n)$ will also be denoted s(n). The difference 104, $d_{LB}(n)$, between s(n) and the local synthesis 105, $\hat{s}_{enh}(n)$, of the CELP encoder at 12 kbit/s is processed by the perceptual weighting filter $W_{LB}(Z)$. The parameters of $W_{LB}(z)$ are derived from the quantized LP coefficients of the CELP encoder. Furthermore, the filter $W_{LB}(z)$ includes a gain compensation which guarantees the spectral continuity between the output 106, $d_{LB}^{w}(n)$, of $W_{LB}(z)$ and the higher-band input signal 107, $s_{HB}(n)$. The weighted difference $d_{LB}^{w}(n)$ is then transformed into frequency domain by MDCT. The higher-band input signal 108, $S_{HB}^{fold}(n)$, obtained after decimation and spectral folding by $(-1)^n$ is pre-processed by a low-pass filter $H_{h2}(z)$ with 3000 Hz cut-off frequency. The resulting signal $S_{HB}(n)$ is coded by the TDBWE encoder. The signal $s_{HB}(n)$ is also transformed into frequency domain by MDCT. The two sets of MDCT coefficients 109, $D_{LB}^{w}(k)$, and 110, $S_{HB}(k)$, are finally coded by the TDAC encoder. In addition, some parameters are transmitted by the frame erasure concealment (FEC) encoder in order to introduce parameter-level redundancy in the bitstream. This redundancy allows improving quality in the presence of erased superframes.

TDBWE Encoder

The TDBWE encoder is illustrated in FIG. 2. The Time Domain Bandwidth Extension (TDBWE) encoder extracts a fairly coarse parametric description from the pre-processed and downsampled higher-band signal 201, $S_{HB}(n)$. This parametric description comprises time envelope 202 and frequency envelope 203 parameters. A summarized description of respective envelope computations and the parameter quantization scheme will be given later.

The 20 ms input speech superframe 201, $s_{HB}(n)$ is subdivided into 16 segments of length 1.25 ms each, i.e., each segment comprises 10 samples. The 16 time envelope parameters 202, $T_{env}(i)$, i=0, . . . , 15, are computed as logarithmic subframe energies:

$$T_{env}(i) = \frac{1}{2}\log_2\left(1/10\sum_{n=0}^{9} S_{HB}^2(n+i\cdot 10)\right),\ i=0,\ldots,15 \quad (1)$$

The TDBWE parameters $T_{env}(i)$, i=0, . . . , 15, are quantized by mean-removed split vector quantization. First, a mean time envelope 204 is calculated:

$$M_T = \frac{1}{16}\sum_{i=0}^{15} T_{env}(i) \quad (2)$$

The mean value 204, $M_T$, is then scalar quantized with 5 bits using uniform 3 dB steps in log domain. This quantization gives the quantized value 205, $\hat{M}_T$. The quantized mean is then subtracted:

$$T_{env}^M(i)=T_{env}(i)-M\hat{M}_T,\ i=0,\ldots,15 \quad (3)$$

The mean-removed time envelope parameter set is split into two vectors of dimension 8

$$T_{env,1}=(T_{env}^M(0),T_{env}^M(1)_1,\ldots,T_{env}^M(7)) \text{ and } T_{env,2}=(T_{env}^M(8),T_{env}^M(9),\ldots T_{env}^M(15)) \quad (4)$$

Finally, vector quantization using pre-trained quantization tables is applied. Note that the vectors $T_{env,1}$ and $T_{env,2}$ share the same vector quantization codebooks to reduce storage requirements. The codebooks (or quantization tables) for $T_{env,1}/T_{env,2}$ have been generated by modifying generalized Lloyd-Max centroids such that a minimal distance between two centroids is verified. The codebook modification procedure consists in rounding Lloyd-Max centroids on a rectangular grid with a step size of 6 dB in log domain.

For the computation of the 12 frequency envelope parameters 203, $F_{env}(j)$, j=0, . . . , 11, the signal 201, $s_{HB}(n)$, is windowed by a slightly asymmetric analysis window $w_F(n)$. The maximum of the window $w_F(n)$ is centered on the second 10 ms frame of the current superframe. The window $w_F(n)$ is constructed such that the frequency envelope computation has a lookahead of 16 samples (2 ms) and a lookback of 32 samples (4 ms). The windowed signal $s_{dHB}^w(n)$ is transformed by FFT. Finally, the frequency envelope parameter set is calculated as logarithmic weighted sub-band energies for 12 evenly spaced and equally wide overlapping sub-bands in the FFT domain. The j-th sub-band starts at the FFT bin of index 2j and spans a bandwidth of 3 FFT bins.

G729.1 Decoder

A functional diagram of the decoder is presented in FIG. 3. The specific case of frame erasure concealment is not considered in this figure. The decoding depends on the actual number of received layers or equivalently on the received bit rate.

If the received bit rate is:

- 8 kbit/s (Layer 1): The core layer is decoded by the embedded CELP decoder to obtain 301, $\hat{s}_{LB}(n)=\hat{s}(n)$. Then (n) is postfiltered into 302, $\hat{s}_{LB}^{post}(n)$, and post-processed by a high-pass filter (HPF) into 303, $\hat{s}_{LB}^{qmf}(n)=\hat{s}_{LB}^{hpf}(n)$. The QMF synthesis filterbank defined by the filters $G_1(z)$ and $G_2(Z)$ generates the output with a high-frequency synthesis 304, $\hat{s}_{HB}^{qmf}(n)$, set to zero.
- 12 kbit/s (Layers 1 and 2): The core layer and narrowband enhancement layer are decoded by the embedded CELP decoder to obtain 301, $\hat{s}_{LB}(n)=\hat{s}_{enh}(n)$, and $\hat{s}_{LB}(n)$ is then postfiltered into 302, $\hat{s}_{LB}^{post}(n)$ and high-pass filtered to obtain 303, $\hat{s}_{LB}^{qmf}(n)=\hat{s}_{LB}^{hpf}(n)$. The QMF synthesis filterbank generates the output with a high-frequency synthesis 304, $\hat{s}_{HB}^{qmf}(n)$ set to zero.
- 14 kbit/s (Layers 1 to 3): In addition to the narrowband CELP decoding and lower-band adaptive postfiltering, the TDBWE decoder produces a high-frequency synthesis 305, $\hat{s}_{LB}^{qmf}(n)$ which is then transformed into frequency domain by MDCT so as to zero the frequency band above 3000 Hz in the higher-band spectrum 306, $\hat{S}_{HB}^{bwe}(k)$. The resulting spectrum 307, $\hat{S}_{HB}(k)$ is transformed in time domain by inverse MDCT and overlap-add before spectral folding by $(-1)^n$. In the QMF synthesis filterbank the reconstructed higher band signal 304, $\hat{s}_{HB}^{qmf}(n)$ is combined with the respective lower band signal 302, $\hat{s}_{LB}^{qmf}(n)=\hat{s}_{LB}^{post}(n)$ reconstructed at 12 kbit/s without high-pass filtering.
- Above 14 kbit/s (Layers 1 to 4+): In addition to the narrowband CELP and TDBWE decoding, the TDAC decoder reconstructs MDCT coefficients 308, $\hat{D}_{LB}^w(k)$ and 307, $\hat{S}_{HB}(k)$, which correspond to the reconstructed weighted difference in lower band (0-4000 Hz) and the reconstructed signal in higher band (4000-7000 Hz). Note that in the higher band, the non-received sub-bands and the sub-bands with zero bit allocation in TDAC decoding are replaced by the level-adjusted sub-bands of $\hat{S}_{HB}^{bwe}(k)$. Both $\hat{D}_{LB}^w(k)$ and $\hat{S}_{HB}(k)$ are transformed into time domain by inverse MDCT and overlap-add. The lower-band signal 309, $\hat{d}_{LB}^w(n)$ is then processed by the inverse perceptual weighting filter $W_{LB}(Z)^{-1}$. To attenuate transform coding artefacts, pre/post-echoes are detected and reduced in both the lower- and higher-band signals 310, $\hat{d}_{LB}(n)$ and 311, $\hat{s}_{HB}(n)$. The lower-band synthesis $\hat{s}_{LB}(n)$ is postfiltered, while the higher-band synthesis 312, $\hat{s}_{HB}^{fold}(n)$, is spectrally folded by $(-1)^n$. The signals $\hat{s}_{LB}^{qmf}(n)=\hat{s}_{LB}^{post}(n)$ and $\hat{s}_{HB}^{qmf}(n)$ are then combined and upsampled in the QMF synthesis filterbank.

TDBWE Decoder

FIG. 4 illustrates the concept of the TDBWE decoder module. The TDBWE received parameters which are used to shape an artificially generated excitation signal 402, $\hat{s}_{HB}^{exc}(n)$, according to desired time and frequency envelopes 408, $\hat{T}_{env}(i)$, and 409, $\hat{F}_{env}(j)$. This is followed by a time-domain post-processing procedure.

The quantized parameter set consists of the value $\hat{M}_T$ and of the following vectors: $\hat{T}_{env,1}$, $\hat{T}_{env,2}$, $\hat{F}_{env,1}$, $\hat{F}_{env,2}$ and $\hat{F}_{env,3}$. The split vectors are defined by Equations 4. The quantized mean time envelope $\hat{M}_T$ is used to reconstruct the time envelope and the frequency envelope parameters from the individual vector components, i.e.

$$\hat{T}_{env}(i)=\hat{T}_{env}^M(i)+\hat{M}_T,\ i=0,\ldots,15 \quad (5)$$

and $$\hat{F}_{env}(j)=\hat{F}_{env}^M(j)+\hat{M}_T,\ j=0,\ldots,11 \quad (6)$$

The TDBWE excitation signal 401, exc(n), is generated by 5 ms subframe based on parameters which are transmitted in Layers 1 and 2 of the bitstream. Specifically, the following parameters are used: the integer pitch lag $T_0=\text{int}(T_1)$ or int $(T_2)$ depending on the subframe, the fractional pitch lag frac, the energy of the fixed codebook contributions $$E_c = \sum_{n=0}^{39} (\hat{g}_c\cdot c(n)+\hat{g}_{enh}\cdot c'(n))^2,$$

and the energy of the adaptive codebook contribution $$E_p = \sum_{n=0}^{39} (\hat{g}_p \cdot v(n))^2.$$

The parameters of the excitation generation are computed every 5 ms subframe. The excitation signal generation consists of the following steps:

estimating two gains $g_v$ and $g_{uv}$ for the voiced and unvoiced contributions to the final excitation signal 401, exc(n);

pitch lag post-processing;

generating the voiced contribution;

generating the unvoiced contribution; and low-pass filtering.

The shaping of the time envelope of the excitation signal 402, $s_{HB}^{exc}(n)$, utilizes the decoded time envelope parameters 408, $\hat{T}_{env}(i)$, with i=0, . . . , 15 to obtain a signal 403, $\hat{s}_{HB}^{T}(n)$, with a time envelope which is near-identical to the time envelope of the encoder side higher-band signal 201, $s_{HB}(n)$. This is achieved by simple scalar multiplication:

$$\hat{s}_{HB}^{T}(n)=g_T(n)\cdot s_{HB}^{exc}(n),\ n=0, \ldots, 159 \tag{7}$$

In order to determine the gain function $g_T(n)$, the excitation signal 402, $s_{HB}^{exc}(n)$, is segmented and analyzed in the same manner as the parameter extraction in the encoder. The obtained analysis results are, again, time envelope parameters $\tilde{T}_{env}(i)$ with i=0, . . . , 15. They describe the observed time envelope of $s_{HB}^{exc}(n)$. Then a preliminary gain factor is calculated:

$$g'_T(i)=2^{\hat{T}_{env}(i)-\tilde{T}_{env}(i)},\ i=0, \ldots, 15 \tag{8}$$

For each signal segment with index i=0, . . . , 15, these gain factors are interpolated using a "flat-top" Hanning window $$w_t(n) = \begin{cases} \frac{1}{2}\cdot\left[1-\cos\left((n+1)\cdot\frac{\pi}{6}\right)\right] & n=0, \ldots, 4 \\ 1 & n=5, \ldots, 9 \\ \frac{1}{2}\cdot\left[1-\cos\left((n+9)\cdot\frac{\pi}{6}\right)\right] & n=10, \ldots, 14 \end{cases} \tag{9}$$

This interpolation procedure finally yields the desired gain function:

$$g_T(n+i\cdot 10) = \begin{cases} w_t(n)\cdot g'_T(i) + w_t(n+10)\cdot g'_T(i-1) & n=0, \ldots, 4 \\ w_t(n)\cdot g'_T(i) & n=5, \ldots, 9 \end{cases} \tag{10}$$

where $g'_T(-1)$ is defined as the memorized gain factor $g'_T(15)$ from the last 1.25 ms segment of the preceding superframe.

The signal $\hat{s}_{HB}^{F}(n)$, was obtained by shaping the excitation signal $s_{HB}^{exc}(n)$ (generated from parameters estimated in lower-band by the CELP decoder) according to the desired time and frequency envelopes. There is in general no coupling between this excitation and the related envelope shapes $\hat{T}_{env}(i)$ and $\hat{F}_{env}(j)$. As a result, some clicks may be present in the signal $\hat{s}_{HB}^{F}(n)$. To attenuate these artifacts, an adaptive amplitude compression is applied to $\hat{s}_{HB}^{F}(n)$. Each sample of $\hat{s}_{HB}^{F}(n)$ of the i-th 1.25 ms segment is compared to the decoded time envelope $\hat{T}_{env}(i)$ and the amplitude of $\hat{s}_{HB}^{f}(n)$ is compressed in order to attenuate large deviations from this envelope. The TDBWE synthesis 405, $\hat{s}_{HB}^{bwe}(n)$, is transformed to $\hat{S}_{HB}^{bwe}(k)$ by MDCT. This spectrum is used by the TDAC decoder to extrapolate missing sub-bands.

SUMMARY OF THE INVENTION

Fine or precise quantization of temporal envelope shaping can clearly reduce echoes and perceptual distortion; but it could require lot of bits if traditional approach is used. This invention proposes a more efficient way to quantize temporal envelope shaping of high band signal by benefiting from energy relationship between low band signal and high band signal; if the low band signal is well coded or it is coded with time domain codec such as CELP, temporal envelope shaping information of available low band signal can be used to predict temporal envelope shaping of high band signal; the temporal envelope shaping prediction can bring significant saving of bits to precisely quantize the temporal envelope shaping of high band signal. This prediction approach can be combined with other specific approach to further increase the efficiency and save mores bits.

In one embodiment, an encoding method comprises the steps of: obtaining temporal envelope shaping from a low band signal; calculating an energy ratio between a high band signal and the low band signal, and quantizing the energy ratio; and sending the quantized low band signal and the quantized energy ratio to decoder. The high band signal and the low band signal respectively have a plurality of frames; each of the plurality of frames has a plurality of sub-segments; the energy ratio between high band signal and low band signal is estimated at least once per frame. Some of the energy ratios between current frame and previous frame can be interpolated in Log domain or Linear domain.

In another embodiment, the encoding method further comprises: multiplying the temporal envelope shaping of low band signal with the energy ratio to obtain a predicted temporal envelope shape of the high band signal; estimating correction errors of the predicted temporal envelope shaping compared to the ideal temporal envelope shaping; and sending the quantized correction errors to decoder.

In another embodiment, a decoding method comprises: receiving low band signal from a coder; estimating temporal envelope shape from the received low band signal; obtaining an energy ratio between high band signal and low band signal; multiplying the temporal envelope shape of low band signal with the energy ratio(s) to obtain a predicted temporal envelope shape of the high band signal; obtaining the high band signal according to the temporal envelope shape of the high band signal.

In another embodiment, the decoding method further comprises: receiving a quantized energy ratio transmitted from a coder, or estimating average energy ratios between decoded high band signal and decoded low band signal at decoder. Some of the energy ratios between current frame and previous frame can be interpolated in Log domain or Linear domain.

In another embodiment, the decoding method comprises: estimating correction errors of the predicted temporal envelope shape according to received information from encoder; and the high band signal is obtained according to the predicted and corrected temporal envelope shape of the high band signal.

BRIEF DESCRIPTION OF THE DRAWINGS

The features and advantages of the present invention will become more readily apparent to those ordinarily skilled in the art after reviewing the following detailed description and accompanying drawings, wherein:

FIG. 7(*b*) shows a basic principle of BWE which includes prediction of temporal envelope shaping.

DETAILED DESCRIPTION OF THE EMBODIMENTS

Figure 1:
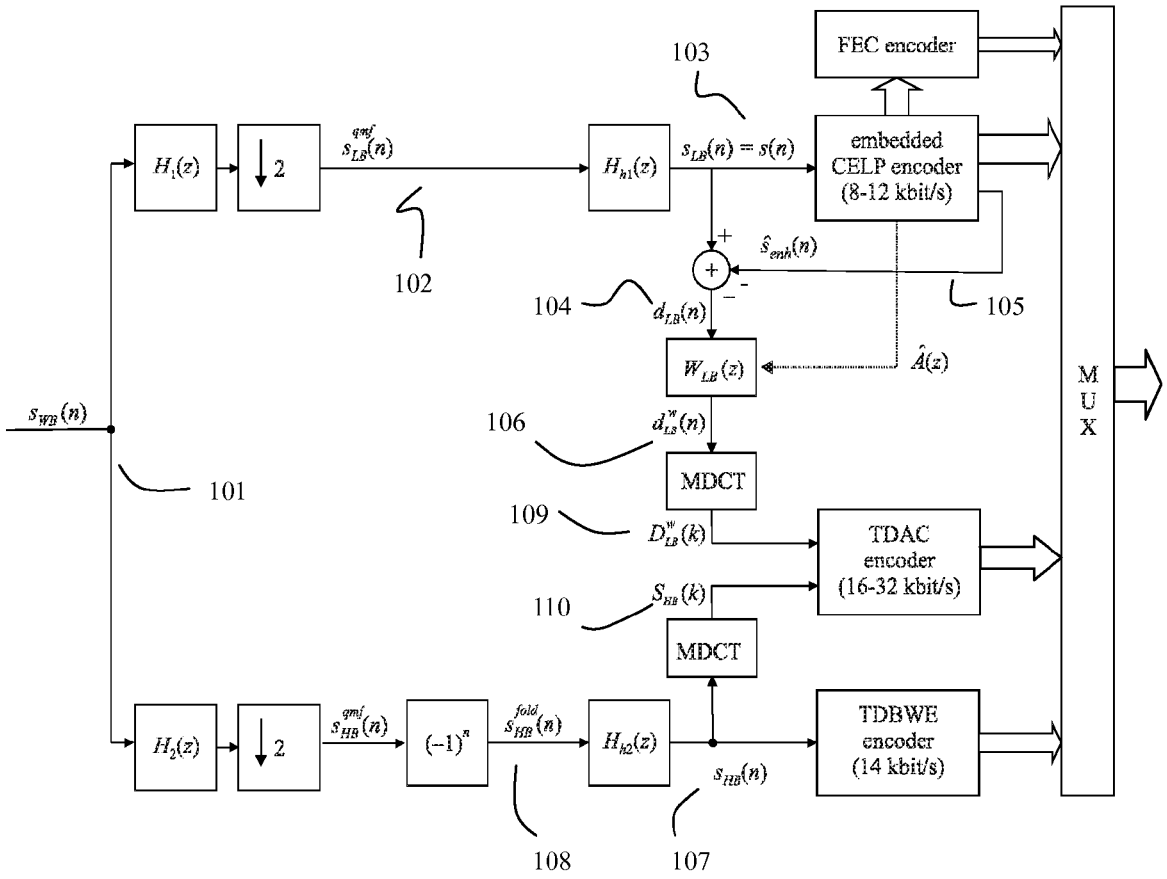
FIG. 1 (Prior Art)
FIG. 1 gives a high-level block diagram of the G.729.1 encoder.
Figure 2:
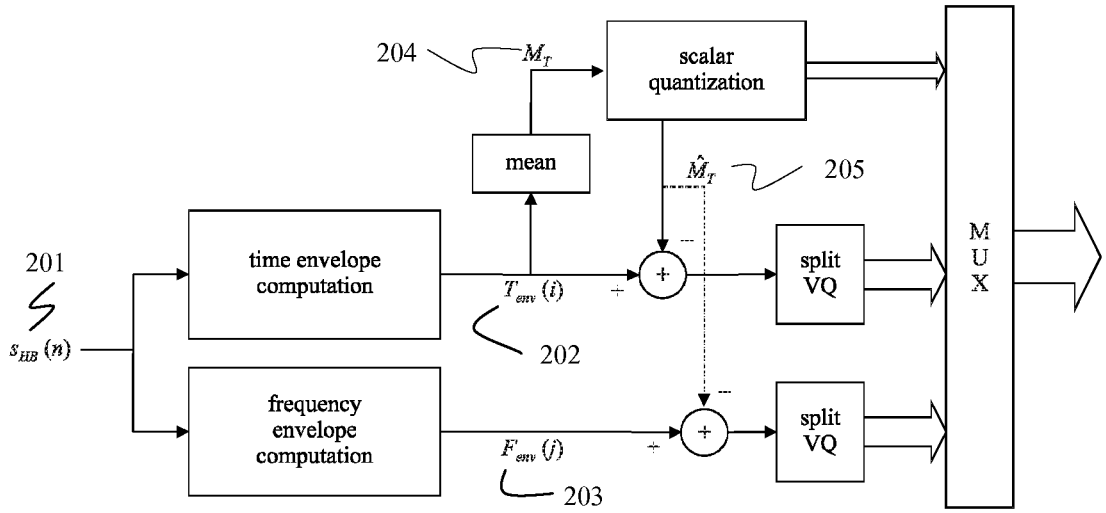
FIG. 2 (Prior Art)
FIG. 2 gives a high-level block diagram of the TDBWE encoder for G.729.1.
Figure 3:
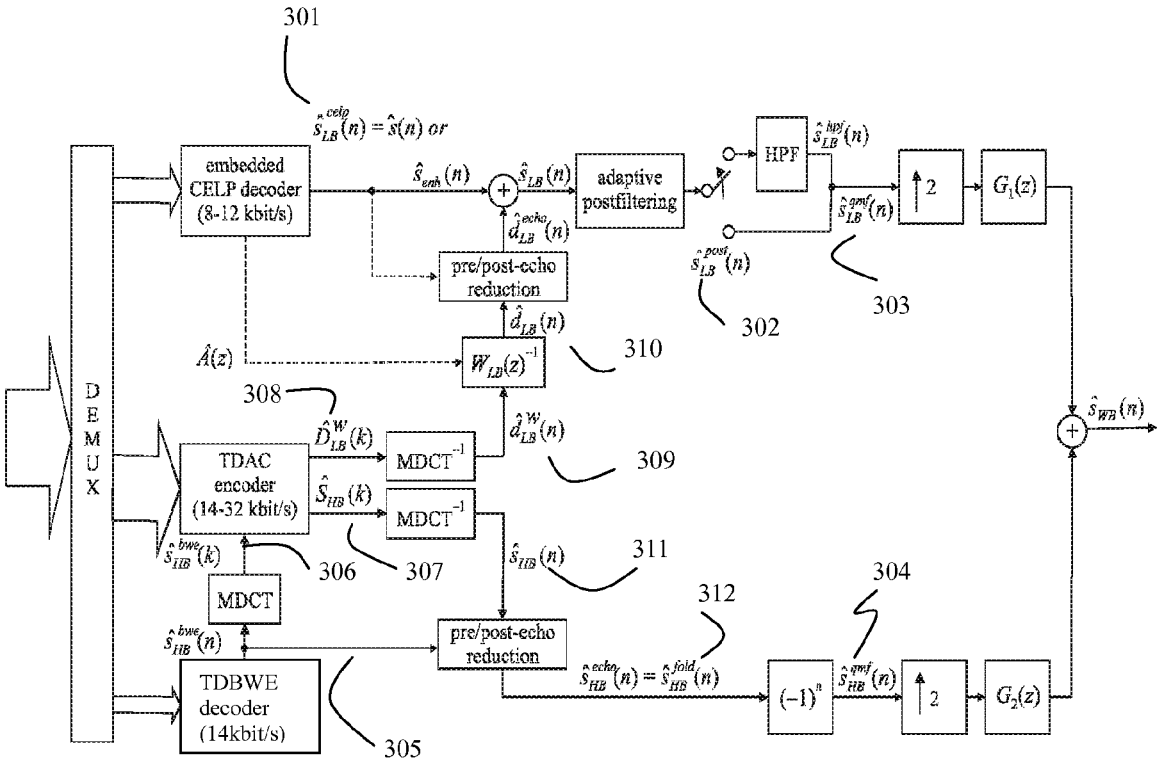
FIG. 3 (Prior Art)
FIG. 3 gives a high-level block diagram of the G.729.1 decoder.
Figure 4:
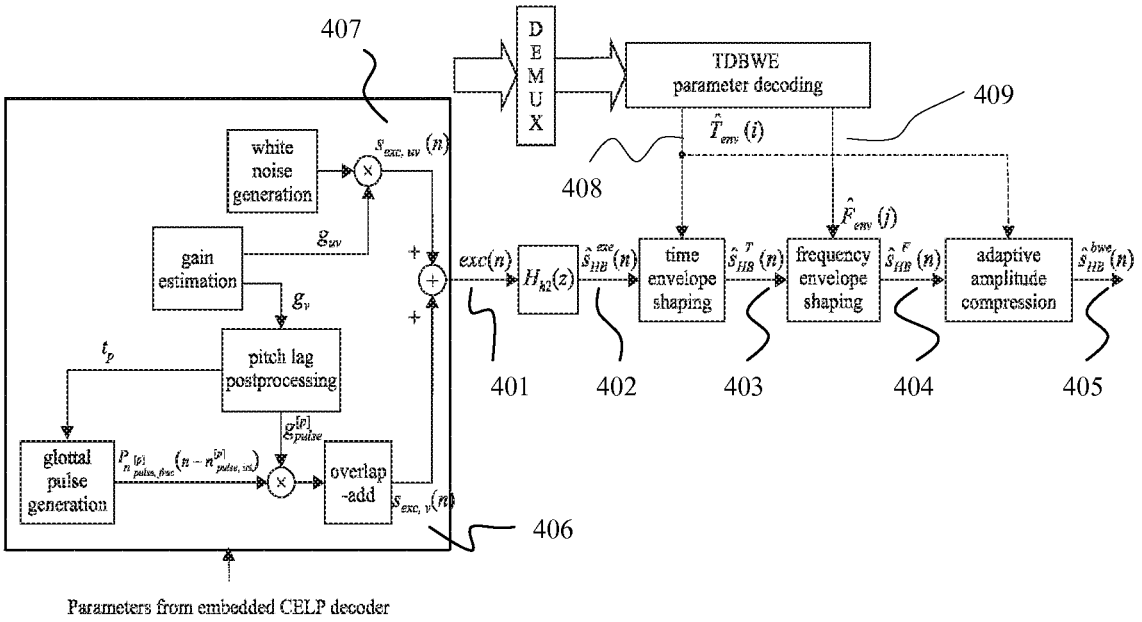
FIG. 4 (Prior Art)
FIG. 4 gives a high-level block diagram of the TDBWE decoder for G.729.1.

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative of specific ways to make and use the embodiments, and do not limit the scope of the disclosure.

If bit rate for transform coding is high enough, spectral subbands are often coded with some kinds of vector quantization (VQ) approaches; if bit rate for transform coding is very low, a concept of BandWidth Extension (BWE) is well possible to be used. The BWE concept sometimes is also called High Band Extension (HBE) or SubBand Replica (SBR). Although the name could be different, they all have the similar meaning of encoding/decoding some frequency sub-bands (usually high bands) with little budget of bit rate or significantly lower bit rate than normal encoding/decoding approach. BWE often encodes and decodes some perceptually critical information within bit budget while generating some information with very limited bit budget or without spending any number of bits; BWE usually comprises frequency envelope coding, temporal envelope coding, and spectral fine structure generation. The precise description of spectral fine structure needs a lot of bits, which becomes not realistic for any BWE algorithm. A realistic way is to artificially generate spectral fine structure, which means that the spectral fine structure could be copied from other bands or mathematically generated according to limited available parameters. The corresponding signal in time domain of fine spectral structure with its spectral envelope removed is usually called excitation. One of the problems for low bit rate encoding/decoding algorithms including BWE is that coded temporal envelope could be quite different from original temporal envelope, resulting in serious local distortion of the energy ratio between low band signal and high band signal although the long time average energy ratio between low band signal and high band signal may be kept reasonable. Sometimes, signal absolute energy level distortion is not very audible; however, relative energy level distortion between low band signal and high band signal is more audible.

Unavoidable errors in generating fine spectrum could lead to unstable decoded signal or obviously audible echoes especially for fast changing signal. For transform coding, more audible distortion could be introduced for fast changing signal than slow changing signal. Typical fast changing signal is energy attack signal which is also called transient signal. The unavoidable error in generating or decoding fine spectrum at very low bit rate could lead to unstable decoded signal or obviously audible echoes especially for energy attack signal. Pre-echo and post-echo are typical artifacts in low-bit-rate transform coding. Pre-echo is audible especially in regions before energy attack point (preceding sharp transient), such as clean speech onsets or percussive sound attacks (e.g. castanets). Indeed, pre-echo is coding noise that is injected in transform domain but is spread in time domain over the synthesis window by the transform decoder. For an energy attack signal (a transient) with sharp energy increase, the low-energy region of the input signal before the energy attack point (preceding the transient) is therefore mixed with noise or unstable energy variation, and the signal to noise ratio (in dB) is often negative in such low-energy parts. A similar artifact, post-echo, exists after a sudden signal offsets. However post-echo is usually less a problem due to post-masking properties. Also, in real sounds recordings a sudden signal offset is rarely observed due to reverberation. Technically, the name echo is referred to pre-echo and post-echo generated by transform coding. Many methods have been proposed to solve the problem of echo in transform audio coding, especially for the case of modified discrete cosine transform (MDCT) coding. One approach is to make the filterbank signal adaptive, using window switching controlled by transient detection. Usually window switching implies extra delay and complexity compared with using a non-adaptive filterbank; furthermore, short windows result in lower transform coding gains than long windows, and side information needs to be sent to the decoder to indicate the switching decision. A similar idea (in frequency domain) is to use adaptive subband decomposition via biorthogonal lapped transform. Another approach consists in performing temporal noise shaping (TNS). Note that TNS requires the transmission of noise shaping filter coefficients as side information. Other methods have been considered, e.g. transient modification prior to transform coding or synthesis window switching controlled by transient detection at the decoder.

Figure 5:
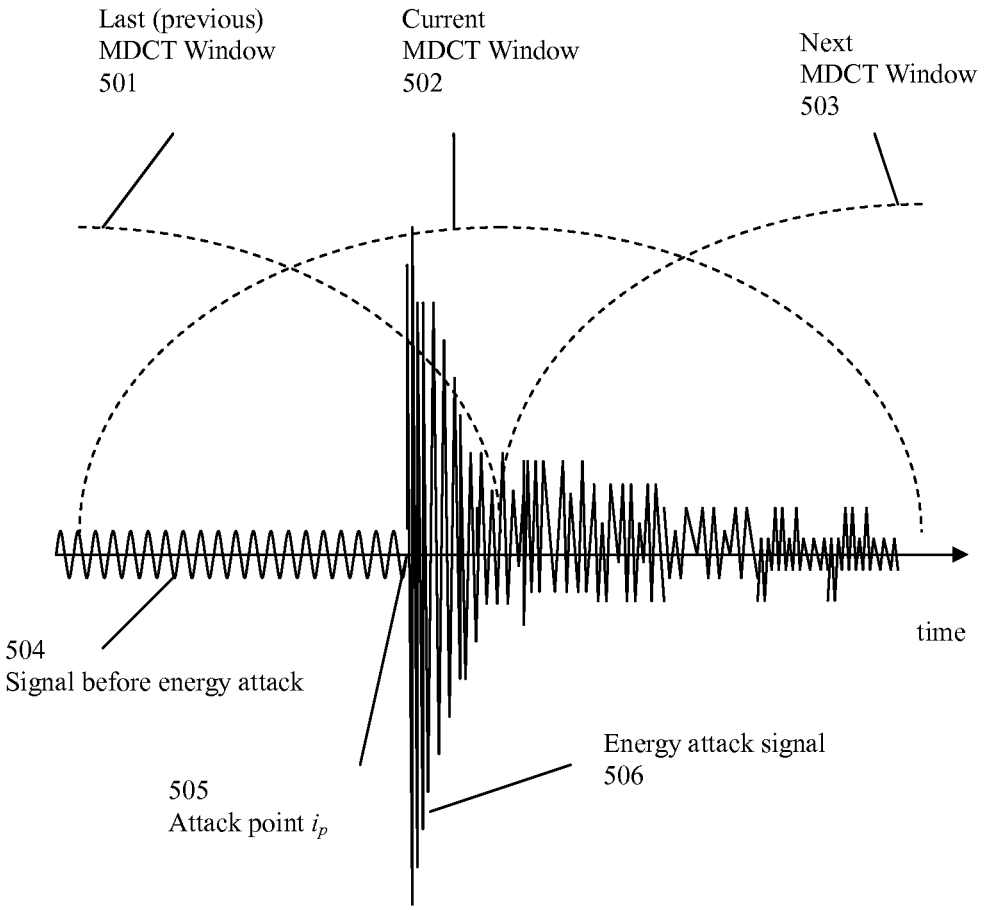
FIG. 5 shows an example of original energy attack signal in time domain.
Figure 6:
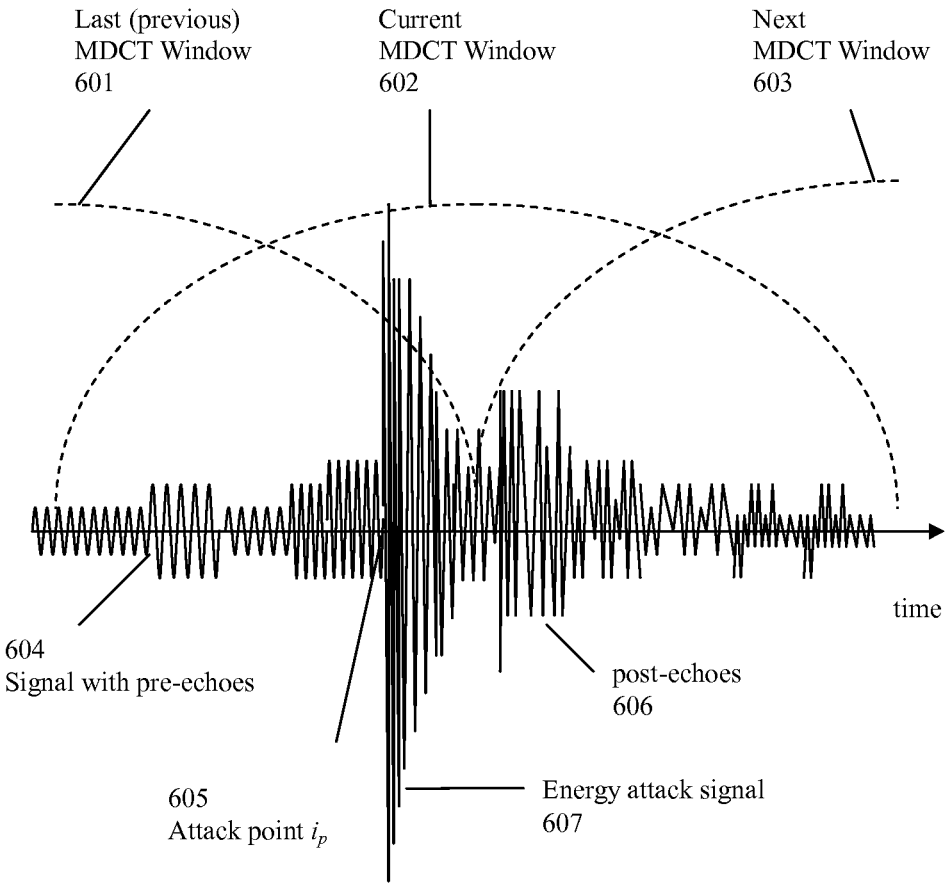
FIG. 6 shows an example of decoded energy attack signal with pre-echoes.

FIG. 5 shows a typical energy attack signal in time domain. As shown in the figure, before the energy attack point 505, the signal energy 504 is relatively low and the signal energy is stable; just after the energy attack point, the signal energy 506 suddenly increases a lot and the spectrum could also dramatically change. MDCT transformation is performed on a windowed signal; two adjacent windows are overlapped each other; the window size could be as large as 40 ms with 20 ms overlapped in order to increase the efficiency of MDCT-based audio coding algorithm. 501 shows previous MDCT window; 502 indicates current MDCT window; 503 is next MDCT window. For energy attack signal, one window or one frame could cover two totally different segments of signals, causing difficult temporal envelope coding with traditional scalar quantization (SQ) or vector quantization (VQ); in traditional way, precise SQ and VQ of the temporal envelope for energy attack signal requires quite lot of bits; rough quantization of the temporal envelope for energy attack signal could result in undesired remaining pre-echoes as shown in FIG. 6. 601 shows previous MDCT window; 602 indicates current MDCT window; 603 is next MDCT window. 604 is the signal with pre-echo before the attack point 605; 607 is energy attack signal after the attack point; 606 shows the signal with post-echo.

One efficient approach to suppress pre-echo and post-echo is to do temporal envelope shaping which has been used in TDBWE algorithm of ITU-T G.729.1. Fine or precise quantization of the temporal envelope shaping can clearly reduce echoes and perceptual distortion; but it could require lot of bits if traditional approach is used. TDBWE have spent quite lot of bits to encode temporal envelope. A more efficient way to quantize temporal envelope shaping is introduced here by benefiting from the energy relationship between low band signal and high band signal; if the low band signal is well coded or it is coded with time domain codec such as CELP, the temporal envelope shaping information of low band signal can be used to predict the temporal envelope shaping of high band signal; temporal envelope shaping prediction can bring significant saving of bits to precisely quantize the temporal envelope shaping of high band signal. This prediction approach can be combined with other specific approach to further increase the efficiency and save mores bits; one example of the other specific approach has been described in author's another patent application titled as "Temporal Envelope Coding of Energy Attack Signal by Using Attack Point Location" with U.S. provisional application No. 61/094,886.

Figure 7A:
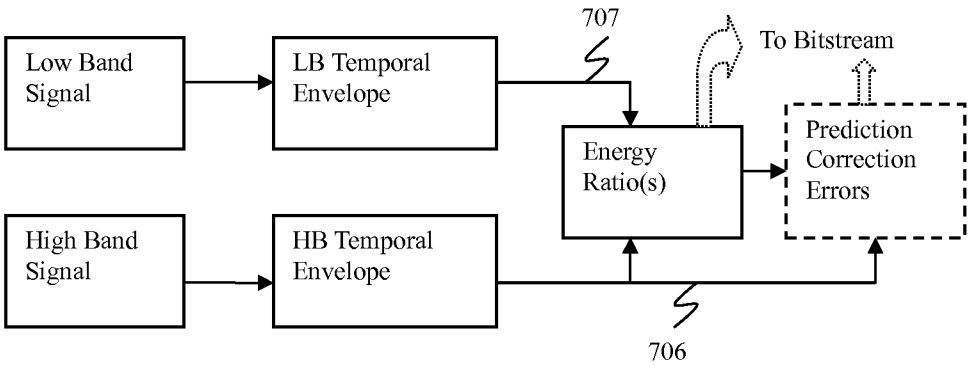
FIG. 7(*a*) shows a basic encoder principle of HB temporal envelope prediction.
Figure 7B:
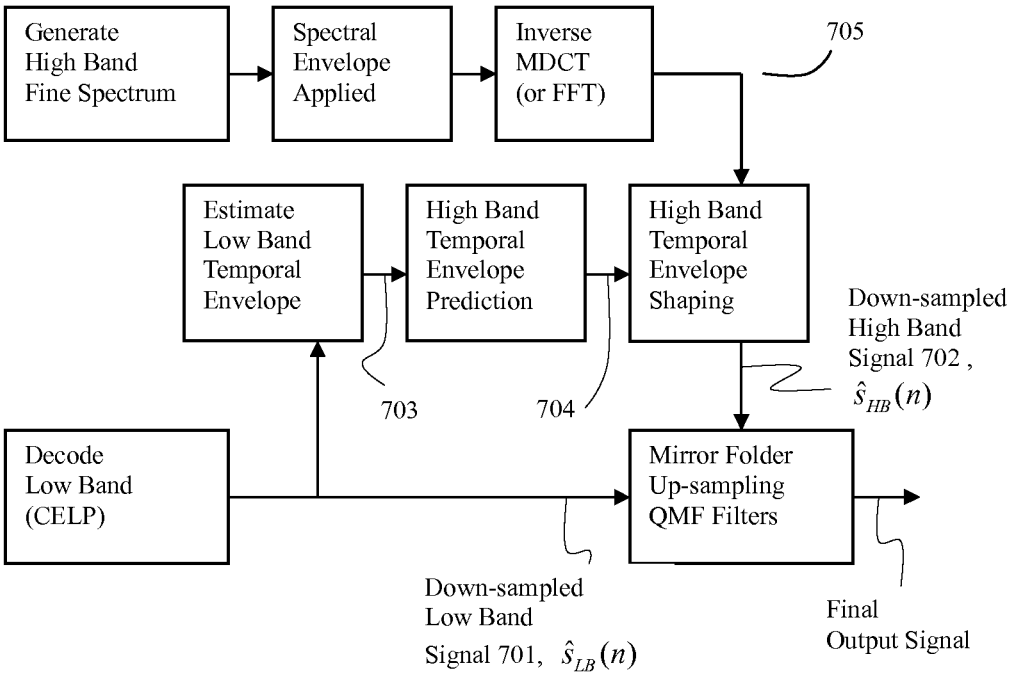

FIG. 7(*a*) shows a basic encoder principle of HB temporal envelope prediction, where 706 is unquantized temporal envelope shaping of high band signal or ideal temporal envelope shaping of high band signal; 707 is unquantized temporal envelope shaping of low band signal or quantized temporal envelope shaping of low band signal if available; the estimation of the Energy Ratio(s) and the Prediction Correction Errors in FIG. 7(*a*) will be described below, which will be quantized and sent to decoder; the bock of the Prediction Correction Errors in FIG. 7(*a*) is dotted because it is optional. FIG. 7(*b*) shows a basic principle of BWE which includes the proposed approach to encode/decode temporal envelope shaping of high band signal. Although temporal envelope coding is often used for BWE-based algorithm, it can be also used for any low bit rate coding to reduce echoes or audible distortion due to incorrect energy ratio between high band signal and low band signal. In FIG. 7, 701 is low band signal decoded with reasonably good codec and it is assumed that the temporal envelope of decoded low band signal is accurate enough, which usually is true for time domain codec such as CELP coding; 703 outputs the temporal envelope estimated from the low band signal; 704 provides the predicted temporal envelope of high band signal by multiplying the temporal envelope of decoded low band signal with the transmitted and interpolated energy ratios between high band signal and low band signal; the predicted temporal envelope may be further improved by transmitted correction information; the initial high band signal 705 is processed through the block of "High Band Temporal Envelope Shaping" to obtain the shaped high band signal 702. The detailed explanation will be given below.

The TDBWE employed in G.729.1 works at the sampling rate of 16000 Hz. The following proposed approach will not be limited at the sampling rate of 16000 Hz; it could also work at the sampling rate of 32000 Hz or any other sampling rate. For the simplicity, the following simplified notations generally mean the same concept for any sampling rate. Suppose the input sampled full band signal $s_{FB}(n)$ is split into high band signal $s_{HB}(n)$ and low band signal $s_{LB}(n)$. The frequency band can be defined in MDCT domain or any other frequency domain such as FFT transformed domain. The full band means all frequencies from 0 Hz to the Nyquist frequency which is the half of the sampling rate; the boundary from low band to high band is not necessary in the middle; the high band is not necessary to be defined until to the end (Nyquist frequency) of the full band. The band splitting can be realized by using low-pass/high-pass filtering, followed by down-sampling and frequency folding, similar to the approach described for G.729.1, $$s_{FB}(n)=QMF\{s_{HB}(n),s_{LB}(n)\} \tag{11}$$

The above notation comes from the fact that the specific low-pass/high-pass filters are traditionally called QMF filter bank. Although $s_{HB}(n)$ and $s_{LB}(n)$ often have the same sampling rate, theoretically different sampling rates can be applied respectively for $s_{HB}(n)$ and $s_{LB}(n)$.

A frame is segmented into many sub-segments. Each sub-segment of high band signal has the same time duration as the sub-segment corresponding to low band signal; if the sampling rates for $s_{HB}(n)$ and $s_{LB}(n)$ are different, the sample numbers of corresponding sub-segments are also different; but they have the same time duration. Temporal envelope shaping consists of plurality of magnitudes; each magnitude represents square root of average energy of each sub-segment, in Linear domain or Log domain as described in G729.1. High band signal temporal envelope described by energy magnitude of each sub-segment is noted as $$T_{HB}(i),\ i=0,1,\ldots,N_s-1; \tag{12}$$

$T_{HB}(i)$ represents energy level of each sub-segment and each frame contains $N_s$ sub-segments. The duration of each sub-segment size depends on real application and it can be as short as 1.25 ms. Spectral envelope of $s_{HB}(n)$ for current frame is noted as $$F_{HB}(k),\ k=0,1,\ldots,M_{HB}-1; \tag{13}$$

which is estimated by transforming a windowed time domain signal of $s_{HB}^{w}(n)$ into frequency domain.

From quality point of view, it is important to have more time-domain sub-segments and more frequency domain sub-bands so that temporal envelope and spectral envelope can be represented more precisely. However, more parameters might require more bits. This invention proposes an efficient way to precisely quantize many temporal envelope segments and spectral envelope parameters without requiring a lot of bits.

Spectral energy envelope curve and temporal energy envelope curve are normally not linear; so they cannot be simply linear-interpolated. However, because spectral envelope shape is often changed very slowly within 20 ms frame, the energy relationship between high band and low band is also slowly changed; for most time, the ratio of high band energy to low band energy can be linearly interpolated between two consecutive frames. Assume low band temporal envelope is $$T_{LB}(i),\ i=0,1,\ldots,N_s-1 \tag{14}$$

$T_{LB}(i)$ represents energy level of each sub-segment and each frame contains $N_s$ sub-segments. Low band spectral envelope is $$F_{LB}(k),\ k=0,1,\ldots,M_{LB}-1; \tag{15}$$

To make the temporal envelope and spectral envelope smoother, an linear or non-linear overlap window similar to the design for G729.1 can be used during the estimation of (12), (13), (14) and (15). If the energy ratio between high band energy $E_{HB}$ and low band energy $E_{LB}$ at the end of one frame is noted as, $$ER(m)=\sqrt{\frac{E_{HB}}{E_{LB}}} \tag{16}$$

instead of directly encoding $E_{HB}$, ER(m) can be coded first, assuming that $E_{LB}$ is available in decoder; the quantization of ER(m) can also be realized in Log domain. If there is no bit to send the quantized ER(m), it can even be estimated at decoder by evaluating average energy ratio between decoded high band signal and decoded low band signal; as mentioned in the above section, this is because spectral envelopes respectively for high band signal and low band signal are already well quantized and sent to decoder, leading to correct average energy levels although local energy levels may be unstable or incorrect.

For most regular signals, ER(m) is able to be interpolated with the previous energy ratio ER(m−1) so that the energy ratio for every small segment between two consecutive frames may be estimated in the following simple way:

$$\begin{aligned} ER_s(i) &= \text{Interp}\{ER(m-1), ER(m)\} \\ &= [(Ns-1-i)\cdot ER(m-1) + (i+1)\cdot ER(m)]/Ns, \\ i &= 0, 1, \ldots, Ns-1; \end{aligned} \tag{17}$$

(17) shows a linear interpolation; however, non-linear interpolation of the energy ratios is also possible depending on specific applications. The frame size can be 20 ms, 10 ms, or any other specific frame size. The energy ratio between high band signal and low band signal can be estimated once per frame, twice per frame or once per sub-frame, wherein most popular frame size is 20 ms and most popular sub-frame size is 5 ms. For the simplicity, suppose (16) is already quantized and (17) is available in decoder side. With (17), high band temporal envelope can be first estimated by $$\hat{T}_{HB}(i)=ER_s(i)\cdot T_{LB}(i),\ i=0,1,\ldots,Ns-1; \tag{18}$$

Here, in (18), $T_{LB}(i)$ is low band temporal envelope which is available in decoder. Finally, instead of directly quantizing $T_{HB}(i)$, the following differences are quantized, $$DT_{HB}(i)=T_{HB}(i)-\hat{T}_{HB}(i),\ i=0,1,\ldots,NS-1; \tag{19}$$

For most regular signals, even if the above difference between the reference temporal envelope and the coded temporal envelope is set to zero (it means no bit is used to code $DT_{HB}(i)$), the quality is still very good. The prediction approach between high band signal and low band signal can be switched to another approach, depending on the prediction accuracy. To guarantee the quality while reducing significantly the coding bit rate, a flag spending 1 bit could be introduced to identify if the above approach is good enough or not by using the following prediction accuracy measures:

$$\overline{\text{ERROR}} = \frac{\sum_i |T_{HB}(i) - \hat{T}_{HB}(i)|}{\sum_i |T_{HB}(i)|}, \text{ or} \tag{20}$$

$$\overline{\text{ERROR}} = \sqrt{\frac{\sum_i |T_{HB}(i) - \hat{T}_{HB}(i)|^2}{\sum_i |T_{HB}(i)|^2}}, \tag{21}$$

If the normalized error defined in (20) or (21) is small enough, it means the approach is very successful, otherwise another quantization approach may be employed or quantization of errors defined in (19) may be added. For most regular signals, (20) and (21) are small.

The above description can be summarized as follows. In one embodiment, an encoding method comprises the steps of: obtaining temporal envelope shaping from a low band signal; calculating an energy ratio between a high band signal and the low band signal, and quantizing the energy ratio; and sending the quantized low band signal and the quantized energy ratio to decoder. The high band signal and the low band signal respectively have a plurality of frames; each of the plurality of frames has a plurality of sub-segments; the energy ratio between high band signal and low band signal is estimated at least once per frame. Some of the energy ratios between current frame and previous frame can be interpolated in Log domain or Linear domain.

In another embodiment, the encoding method further comprises: multiplying the temporal envelope shaping of low band signal with the energy ratio to obtain a predicted temporal envelope shape of the high band signal; estimating correction errors of the predicted temporal envelope shaping compared to the ideal temporal envelope shaping; and sending the quantized correction errors to decoder.

In another embodiment, a decoding method comprises: receiving low band signal from a coder; estimating temporal envelope shape from the received low band signal; obtaining an energy ratio between high band signal and low band signal; multiplying the temporal envelope shape of low band signal with the energy ratio(s) to obtain a predicted temporal envelope shape of the high band signal; obtaining the high band signal according to the temporal envelope shape of the high band signal.

In another embodiment, the decoding method further comprises: receiving a quantized energy ratio transmitted from a coder, or estimating average energy ratios between decoded high band signal and decoded low band signal at decoder. Some of the energy ratios between current frame and previous frame can be interpolated in Log domain or Linear domain.

In another embodiment, the decoding method comprises: estimating correction errors of the predicted temporal envelope shape according to received information from encoder; and the high band signal is obtained according to the predicted and corrected temporal envelope shape of the high band signal.

Figure 8:
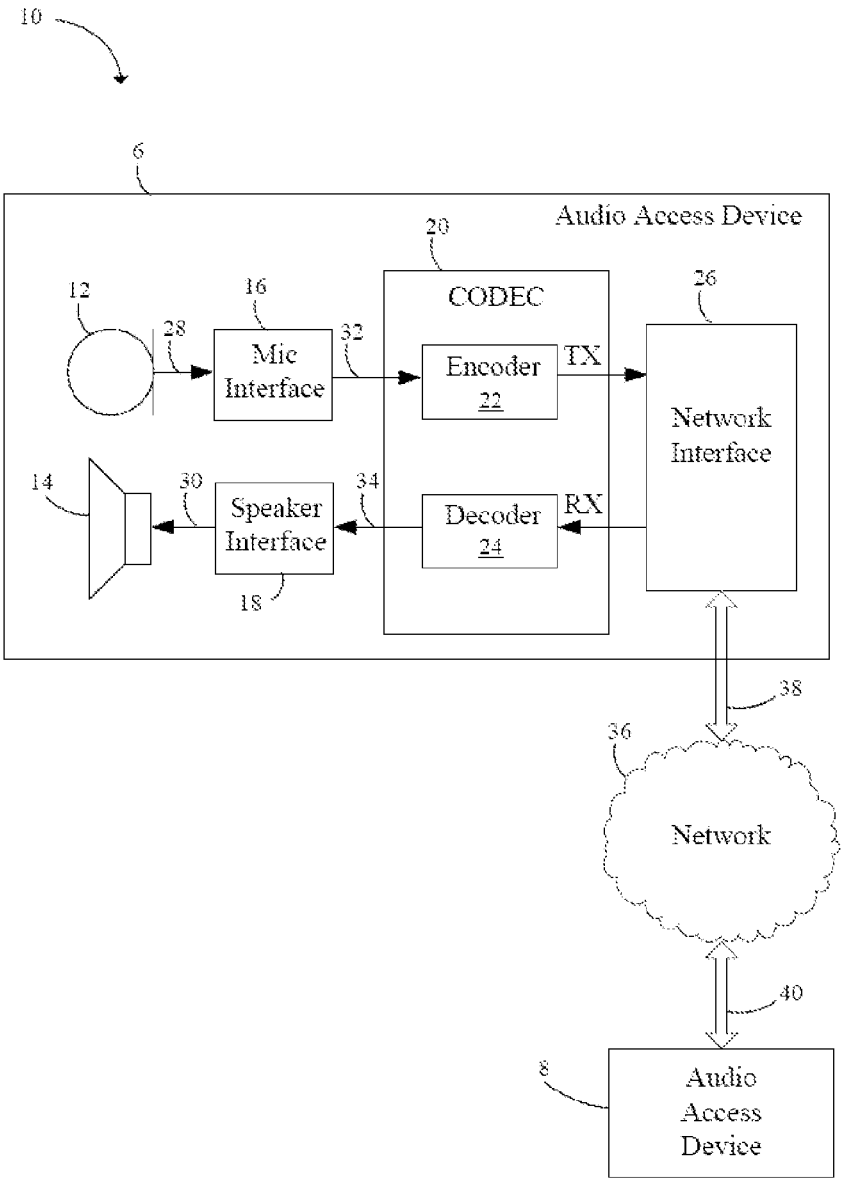
FIG. 8 illustrates communication system according to an embodiment of the present invention.

FIG. 8 illustrates communication system 10 according to an embodiment of the present invention. Communication system 10 has audio access devices 6 and 8 coupled to network 36 via communication links 38 and 40. In one embodiment, audio access device 6 and 8 are voice over internet protocol (VOIP) devices and network 36 is a wide area network (WAN), public switched telephone network (PTSN) and/or the internet. Communication links 38 and 40 are wireline and/or wireless broadband connections. In an alternative embodiment, audio access devices 6 and 8 are cellular or mobile telephones, links 38 and 40 are wireless mobile telephone channels and network 36 represents a mobile telephone network.

Audio access device 6 uses microphone 12 to convert sound, such as music or a person's voice into analog audio input signal 28. Microphone interface 16 converts analog audio input signal 28 into digital audio signal 32 for input into encoder 22 of CODEC 20. Encoder 22 produces encoded audio signal TX for transmission to network 26 via network interface 26 according to embodiments of the present invention. Decoder 24 within CODEC 20 receives encoded audio signal RX from network 36 via network interface 26, and converts encoded audio signal RX into digital audio signal 34. Speaker interface 18 converts digital audio signal 34 into audio signal 30 suitable for driving loudspeaker 14.

In an embodiments of the present invention, where audio access device 6 is a VOIP device, some or all of the components within audio access device 6 are implemented within a handset. In some embodiments, however, Microphone 12 and loudspeaker 14 are separate units, and microphone interface 16, speaker interface 18, CODEC 20 and network interface 26 are implemented within a personal computer. CODEC 20 can be implemented in either software running on a computer or a dedicated processor, or by dedicated hardware, for example, on an application specific integrated circuit (ASIC). Microphone interface 16 is implemented by an analog-to-digital (A/D) converter, as well as other interface circuitry located within the handset and/or within the computer. Likewise, speaker interface 18 is implemented by a digital-to-analog converter and other interface circuitry located within the handset and/or within the computer. In further embodiments, audio access device 6 can be implemented and partitioned in other ways known in the art.

In embodiments of the present invention where audio access device 6 is a cellular or mobile telephone, the elements within audio access device 6 are implemented within a cellular handset. CODEC 20 is implemented by software running on a processor within the handset or by dedicated hardware. In further embodiments of the present invention, audio access device may be implemented in other devices such as peer-to-peer wireline and wireless digital communication systems, such as intercoms, and radio handsets. In applications such as consumer audio devices, audio access device may contain a CODEC with only encoder 22 or decoder 24, for example, in a digital microphone system or music playback device. In other embodiments of the present invention, CODEC 20 can be used without microphone 12 and speaker 14, for example, in cellular base stations that access the PTSN.

The above description contains specific information pertaining to quantizing temporal envelope shaping with prediction between different bands. However, one skilled in the art will recognize that the present invention may be practiced in conjunction with various encoding/decoding algorithms different from those specifically discussed in the present application. Moreover, some of the specific details, which are within the knowledge of a person of ordinary skill in the art, are not discussed to avoid obscuring the present invention.

The drawings in the present application and their accompanying detailed description are directed to merely example embodiments of the invention. To maintain brevity, other embodiments of the invention which use the principles of the present invention are not specifically described in the present application and are not specifically illustrated by the present drawings.

What is claimed is:

1. An audio/speech signal decoding method, comprising:

receiving a low frequency band signal and an energy ratio between a high frequency band signal and the low frequency band signal from an encoder;

estimating a temporal energy envelope shaping of the low frequency band signal from the received low frequency band signal;

multiplying the temporal energy envelope shaping of the low frequency band signal with the energy ratio to obtain a predicted temporal energy envelope shaping of the high frequency band signal; obtaining the high frequency band signal according to the predicted temporal energy envelope shaping of the high frequency band signal; and determining, in response to a flag bit indicating that an estimated error of the predicted temporal energy envelope shaping of the high frequency band signal is low enough, that the obtained high frequency band signal is able to be determined at a determined coding bit rate of the low frequency band signal.

2. The method according to claim 1, further comprising:

decoding the low frequency band signal according to information transmitted from the encoder.

3. The method according to claim 1, further comprising:

estimating average energy ratios between the decoded high frequency band signal and the decoded low frequency band signal according to the received energy ratio(s).

4. The method according to claim 1, wherein the low frequency band signal and the high frequency band signal each has a plurality of frames, and each of the plurality of frames has a plurality of sub-segments, and wherein energy ratios for the sub-segments between a current frame and a previous frame are interpolated by using the received energy ratio(s) in a Log domain or a Linear domain.

5. The method according to claim 1, wherein the error is a normalized error.

6. An audio/speech signal encoding and decoding method, comprising:

predicting a temporal energy envelope shaping of a high frequency band signal from a low frequency band signal;

estimating an energy ratio between the high frequency band signal and the low frequency band signal, and quantizing the energy ratio;

sending the low frequency band signal and the quantized energy ratio from an encoder to a decoder; and decoding an estimated error of the predicted temporal energy envelope shaping of the high frequency band signal based on an adjusted coding bit rate;

wherein predicting a temporal energy envelope shaping of a high frequency band signal from a low frequency band signal comprises multiplying a temporal envelope of the low band signal with the energy ratio.

7. The method according to claim 6, further comprising:

obtaining the high frequency band signal and the low frequency band signal by splitting an input signal.

8. The method according to claim 6, wherein the low frequency band signal has a plurality of frames, and each of the plurality of frames has a plurality of sub-segments; and wherein predicting the temporal energy envelope shaping of the high frequency band signal from the low frequency band signal comprises:

calculating a square root of an average energy of each sub-segment to obtain a plurality of energy magnitudes; and applying the plurality of energy magnitudes to form the temporal energy envelope shaping of the high frequency band signal.

9. The method according to claim 8, wherein a duration of each sub-segment is 1.25 milliseconds.

10. The method according to claim 6, wherein the high frequency band signal and the low frequency band signal respectively have a plurality of frames, and each of the plurality of frames has a plurality of sub-segments; and wherein the energy ratio between the high frequency band signal and the low frequency band signal is estimated at least once per frame.

11. The method according to claim 10, wherein energy ratios for the sub-segments between a current frame and a previous frame are interpolated in a Log domain or a Linear domain.

12. A decoder, comprising:

a receiver; and a processor, wherein the receiver is configured to:

receive at least one low frequency band signal and at least one energy ratio between at least one high frequency band signal and the at least one low frequency band signal from an encoder;

and wherein the processor is configured to:

estimate at least one temporal energy shaping of the at least one low frequency band signal from the at least one received low frequency band signal;

multiply the at least one temporal energy envelope shaping of the at least one low frequency band signal with the at least one energy ratio to obtain at least one predicted temporal energy envelope shaping of the at least one high frequency band signal;

obtain the at least one high frequency band signal according to the at least one predicted temporal energy envelope shaping of the at least one high frequency band signal; and determine, in response to a flag bit indicating that an estimated error of the predicted temporal energy envelope shaping of the high frequency band signal is low enough, that the obtained at least one high frequency band signal is able to be determined at a determined coding bit rate of the at least one low frequency band signal.

13. The decoder of claim 12, wherein the at least one low frequency band signal and the at least one high frequency band signal each has a plurality of frames, and each of the plurality of frames has a plurality of sub-segments, and wherein energy ratios for the sub-segments between a current frame and a previous frame are interpolated by using the received at least one energy ratio in a Log domain or a Linear domain.

14. The decoder of claim 12, wherein the error is a normalized error.

15. An audio/speech signal decoding method, comprising:

receiving a low frequency band signal and an energy ratio between a high frequency band signal and the low frequency band signal from an encoder;

estimating a temporal energy envelope shaping of the low frequency band signal from the received low frequency band signal;

multiplying the temporal energy envelope shaping of the low frequency band signal with the energy ratio to obtain a predicted temporal energy envelope shaping of the high frequency band signal;

obtaining the high frequency band signal according to the predicted temporal energy envelope shaping of the high frequency band signal; and decoding an estimated error of the predicted temporal energy envelope shaping of the high frequency band signal based on an adjusted coding bit rate.

16. A decoder, comprising:

a receiver; and a processor, wherein the receiver is configured to:

receive at least one low frequency band signal and at least one energy ratio between at least one high frequency band signal and the at least one low frequency band signal from an encoder;

and wherein the processor is configured to:

estimate at least one temporal energy shaping of the at least one low frequency band signal from the at least one received low frequency band signal;

multiply the at least one temporal energy envelope shaping of the at least one low frequency band signal with the at least one energy ratio to obtain at least one predicted temporal energy envelope shaping of the at least one high frequency band signal;

obtain the at least one high frequency band signal according to the at least one predicted temporal energy envelope shaping of the at least one high frequency band signal; and decode an estimated error of the at least one predicted temporal energy envelope shaping of the at least one high frequency band signal based on an adjusted coding bit.

* * * * *